US005996378A

United States Patent [19]

McCartney

[11] Patent Number: 5,996,378

[45] Date of Patent: Dec. 7, 1999

[54] KNITTED TEXTILE FABRIC WITH INTEGRATED FLUID-CONTAINING OR -CONVEYING TUBULAR SEGMENTS

[75] Inventor: Phillip D. McCartney, Oak Ridge, N.C.

[73] Assignee: Guilford Mills, Inc., Greensboro, N.C.

[21] Appl. No.: 09/082,019

[22] Filed: May 20, 1998

[51] Int. Cl.[6] ..... D04B 21/08

[52] U.S. Cl. ..... 66/192; 66/195; 66/202; 442/309

[58] Field of Search ..... 66/169 R, 170, 66/171, 190, 192, 195, 202; 2/458, DIG. 1, DIG. 3; 442/194, 309

[56] References Cited

U.S. PATENT DOCUMENTS

| | | | |
|---|---|---|---|
| 1,475,912 | 11/1923 | Williams . | |
| 1,514,329 | 11/1924 | Metcalf . | |
| 2,031,286 | 4/1936 | Fry, Sr. et al. . | |
| 2,158,801 | 5/1939 | Petterson . | |
| 2,791,956 | 5/1957 | Guest . | |
| 3,529,310 | 9/1970 | Olmo . | |
| 3,607,591 | 9/1971 | Hansen | 442/194 |
| 3,738,702 | 6/1973 | Jacobs . | |
| 4,072,344 | 2/1978 | Li . | |
| 4,528,237 | 7/1985 | Tate | 442/194 |
| 4,712,832 | 12/1987 | Antolini et al. . | |
| 4,786,540 | 11/1988 | Bruhnke et al. . | |
| 4,787,219 | 11/1988 | Sato et al. | 66/190 |
| 4,853,992 | 8/1989 | Yu . | |
| 4,898,764 | 2/1990 | Kurihara et al. . | |
| 4,914,836 | 4/1990 | Horovitz . | |
| 4,923,724 | 5/1990 | Day et al. . | |
| 4,981,324 | 1/1991 | Law . | |
| 4,997,230 | 3/1991 | Spitalnick . | |
| 5,080,142 | 1/1992 | Calamito et al. . | |
| 5,108,810 | 4/1992 | Williams . | |
| 5,118,555 | 6/1992 | Horovitz . | |
| 5,139,859 | 8/1992 | Karvanen . | |
| 5,243,706 | 9/1993 | Frim et al. | 2/458 |
| 5,368,696 | 11/1994 | Cunnane, III et al. . | |
| 5,370,439 | 12/1994 | Lowe et al. . | |
| 5,372,402 | 12/1994 | Kuo . | |
| 5,385,382 | 1/1995 | Single, II et al. . | |
| 5,397,621 | 3/1995 | Donzac et al. . | |
| 5,450,894 | 9/1995 | Inoue et al. . | |
| 5,465,764 | 11/1995 | Eschmann et al. . | |
| 5,506,032 | 4/1996 | Rowe . | |
| 5,626,387 | 5/1997 | Yeh . | |

*Primary Examiner*—Larry Worrell, Jr.

*Attorney, Agent, or Firm*—Kennedy Covington Lobdell & Hickman

[57] ABSTRACT

A knitted textile fabric containing integrated fluid-carrying tubes is fabricated of yarn formed into interlooped stitches arranged in longitudinal wales and transverse courses throughout the fabric structure, with plural elongate hollow tubular segments integrated with the yarn into the fabric structure and spaced essentially in parallel relation to one another. The fabric structure is preferably warp knitted, one embodiment of which has the tubular segments extending longitudinally in selected spaced wales and another embodiment of which has the tubular segments extending coursewise in selected spaced courses.

11 Claims, 2 Drawing Sheets

KNITTED TEXTILE FABRIC WITH INTEGRATED FLUID-CONTAINING OR -CONVEYING TUBULAR SEGMENTS

BACKGROUND OF THE INVENTION

The present invention relates generally to textile fabrics, especially knitted textile fabrics, and relates more particularly to a novel knitted textile fabric having elongate hollow tubular segments integrated into the fabric structure for use in containing or conveying fluids across the fabric structure.

Tubes and pipes of varying shapes and sizes are commonly used for containing and conveying fluids, and especially for conveying heating and/or cooling fluids. In various environments, such tubes or pipes may be incorporated into a substrate or the like for structural support and to retain the tubes or pipes in a desired position, orientation or relationship. For example, in recent years, it has become common in luxury automobiles to provide active heating or cooling of the automobile seats from interiorly within the seat structure, in addition to actively cooling and heating the atmosphere within the interior passenger compartment of the automobile. One means of accomplishing the cooling/heating of an automobile seat is to incorporate fluid-carrying tubes, pipes or passageways into the seat structure. As disclosed in U.S. Pat. No. 3,738,702, assigned to General Motors Corporation, such tubes, pipes or passageways may be formed or contained within the foam cushioning commonly utilized in such seats.

While textile fabrics have found numerous and diverse uses and applications across a wide variety of differing industries, including the automobile industry, it is believed that the concept of incorporating fluid-carrying tubes or pipes into the structure of a textile fabric has not heretofore been proposed or attempted, but given the economies which can be realized from the automated fabrication of textile fabrics, such a composite fabric with integrated fluid-carrying tubes or pipes could offer not only cost savings but also expanded industrial applications for textile fabrics, such as in fabricating heated/cooled automobile seat structures as one potential application.

SUMMARY OF THE INVENTION

It is accordingly an object of the present invention to provide a textile fabric structure having hollow elongated tubular segments integrated therein to accommodate any of various and sundry potential applications in which it would be desirable or advantageous to provide a supporting substrate for such pipes or tubes. A more particular object of the present invention is to form such a composite product utilizing a knitted fabric structure, particularly a warp knitted fabric structure. A further object is to provide a means for selective disposition and orientation of such pipes or tubes in the fabric structure, either in a direction longitudinally along the fabric or transversely across the fabric.

These and other objects and advantages are accomplished in accordance with the present invention by a knitted textile fabric basically comprising one or more yarns formed into inter-looped stitches defining a fabric structure having a longitudinal extent and a transverse extent wherein the yarn stitches are aligned longitudinally in a plurality of essentially parallel wales and transversely in a plurality of essentially parallel courses perpendicular to the wales. In accordance with the present invention, a plurality of elongate hollow tubular segments are integrated with such yarn into the fabric structure in spaced essentially parallel relation to one another such that the tubular segments are adapted for carrying a fluid, e.g., by connecting the respective ends of the tubular segments to fluid-distributing intake and exhaust manifolds for conveying a fluid across the fabric structure.

Various embodiments of the knitted textile fabric of the present invention are contemplated. For example, in an embodiment presently contemplated to be a preferred embodiment, the fabric structure may be a warp knitted structure, preferably formed of a dimensionally stable stitch pattern, e.g., an at least two-bar knitted structure fabricated of two sets of warp yarns one formed in a walewise chain stitch pattern (such as a repeating 0-1, 1-0 pattern) and the other formed in a coursewise inlay pattern (such as a 4-4, 0-0 pattern), with an additional set of weft inserted yarns also extending coursewise.

In one variation of such a warp-knitted composite fabric, the stitches are omitted from selected spaced wales and the tubular segments are disposed longitudinally within these selected spaced wales and retained therein by the yarns of the fabric structure, whereby the tubular segments extend walewise (i.e. longitudinally) along the length of the knitted fabric. In an alternative variation of the preferred warp knitted fabric embodiment, the tubular segments are weft inserted coursewise within the stitches of selected spaced courses, thereby to extend transversely across the width of the fabric structure.

DESCRIPTION OF THE PREFERRED EMBODIMENT

As explained more fully herein, the preferred embodiment of the fabric of the present invention is produced on a warp knitting machine which may be of any conventional type of an at least two-bar construction having two or more yarn guide bars and a needle bar, e.g., a conventional tricot warp knitting machine. The construction and operation of such machine are well known in the warp knitting art and need not herein be specifically described and illustrated. In the following description of exemplary embodiments of the invention, the yarn guide bars of a two-bar knitting machine are identified as "top" and "bottom" guide bars and the yarn guide bars of a three-bar knitting machine are identified as "top," "middle" and "bottom" guide bars for references purposes only and not by way of limitation. As those persons skilled in the art will understand, such terms equally identify knitting machines whose guide bars may be referred to as "front," "middle" and "back" guide bars, which machines of course are not to be excluded from the scope and substance of the present invention. As further used herein, the "bar construction" of a warp knitting machine refers to the number of yarn guide bars of the machine, while the "bar construction" of a warp knitted fabric refers to the number of different sets of warp yarns included in the fabric, all as is conventional terminology in the art.

Figure 1:
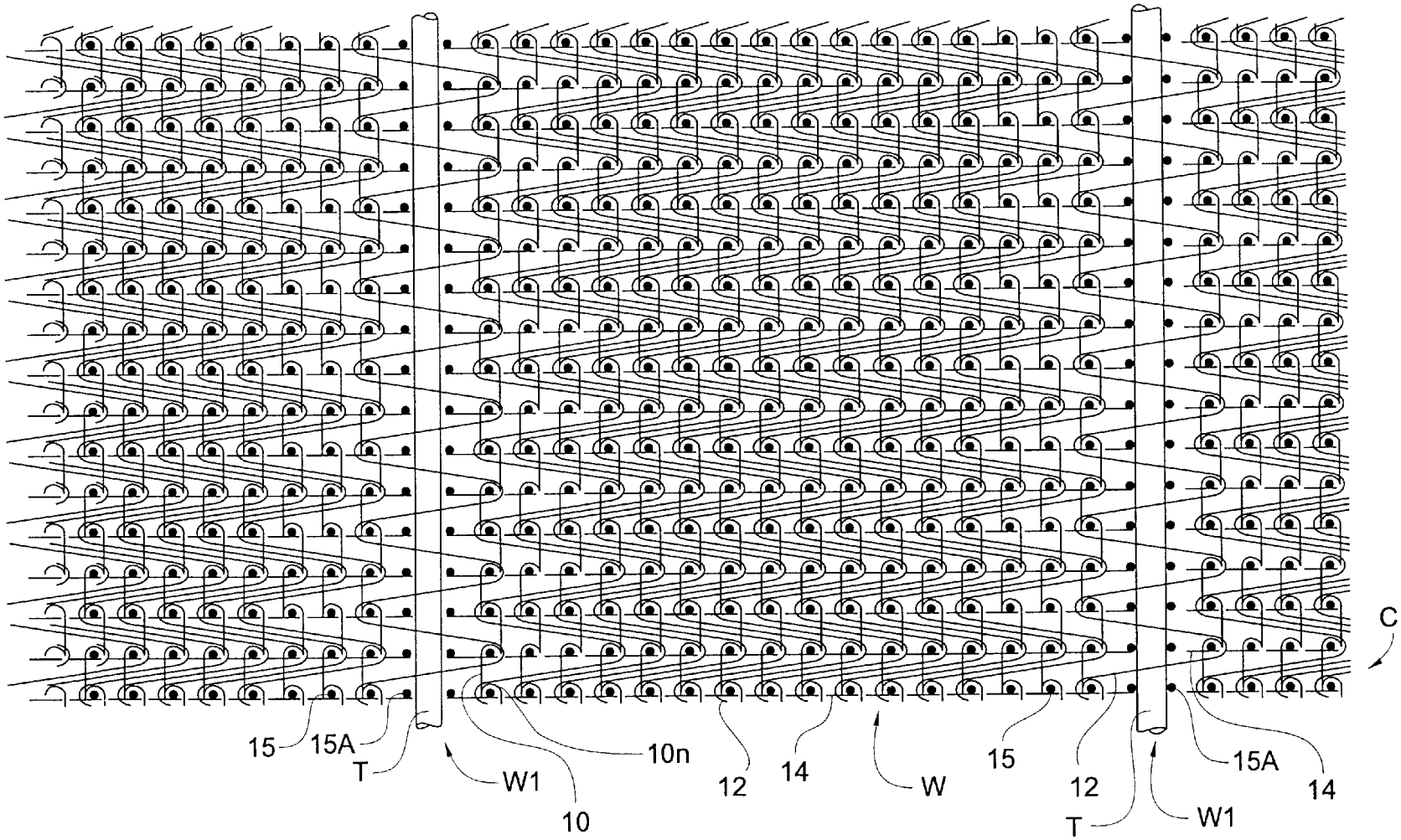
FIG. 1 is a schematic diagram depicting the fabric structure, and the individual stitch patterns for the constituent yarns thereof, in one variation of the preferred warp knitted embodiment of the textile fabric of the present invention.

Referring now initially to FIG. 1 of the accompanying drawings, one particular embodiment of the present textile fabric is illustrated as preferably warp knitted of a three-bar construction on a three-bar weft insertion warp knitting machine. As is conventional, the needle bar of the warp knitting machine carries a series of aligned knitting needles, while each guide bar of the machine carries a series of guide eyes, the needle and guide bars preferably having the same gauge, i.e., the same number of needles and guide eyes per inch.

According to the illustrated embodiment of the present fabric, the top guide bar of the machine is utilized for feeding the elongate tubes T and therefore is equipped with tube guide elements (not shown) at selected spacings along the guide bar. Any desired spacing of the tube guides may be utilized and the spacings may be regular or irregular. In the illustrated fabric of FIG. 1, the tubes T are fed at a regular spacing of sixteen intervening needles, merely for purposes of illustration and by way of example. Within the area at which the tubes T are fed, an appropriate number of needles are removed from the needle bar of the machine to accommodate and avoid interference with the tubes T. In FIG. 1, two needles are shown to have been removed for each tube T, but it is to be understood that the number of removed needles may be more or less depending upon the gauge of the knitting machine and the size and spacing of the tubes.

The middle guide bar is threaded with a set of inlay yarns 12 delivered from a warp beam (not shown) through substantially every guide eye except two guide eyes corresponding to each omitted pair of needles and two additional guide eyes spaced one needle leftwardly (as viewed in FIG. 1) therefrom. The bottom guide bar is threaded with a set of ground yarns 10 supplied from another warp beam (also not shown) on every guide eye except two guide eyes corresponding to each pair of needles omitted from the needle bar. The warp knitting machine additionally includes a weft insertion device supplied with a filling yarn 14 to be inserted across the needles of the needle bar as the fabric is formed, as more fully explained below.

While it is contemplated that a variety of yarns may be suitable for use as the ground, inlay and filling yarns, it is preferred that the yarns be relatively inelastic so as to contribute, along with the stitch construction of the fabric, to the dimensional stability of the fabric. For example, any of a variety of conventional multifilament synthetic yarns, particularly polyester and nylon yarns, would be suitable for use as any or all of the ground, inlay and filling yarns. The denier of the yarns may vary depending upon the desired weight and stiffness of the fabric and its intended application or end use. Various types and sizes of the tubes T may likewise be utilized according to the intended use and application thereof, but in most cases it is contemplated that tubes of a thermo-plastic material sufficiently flexible to perform in the knitting process but otherwise sufficiently stiff and rigid to resist deformation and collapse in use will be preferred.

In the accompanying FIG. 1, the stitch constructions of the ground, inlay and filling yarns 10,12,14, as carried out by the respective lateral traversing movements of the guide bars of the knitting machine and the simultaneous action of the weft insertion device according to one preferred embodiment of the present fabric, are illustrated in a traditional dot or point diagram format, wherein the individual points 15 represent the needles of the needle bar of the knitting machine in the formation of several successive fabric courses C across several successive fabric wales W. According to this embodiment, the bottom (or back) guide bar of the warp knitting machine manipulates the set of ground yarns 10 as they are fed from their respective warp beam to traverse laterally back and forth relative to the needle bar of the machine to stitch the ground yarns 10 on every needle 15 present in the needle bar of the machine in a repeating 0-1, 1-0 chain stitch pattern. To assist in an understanding of the invention, the location of the needles which have been removed from the needle bar are identified at points 15A, it being understood that such points 15A represent missing needles and not active present needles. Similarly, the middle guide bar simultaneously manipulates the set of inlay yarns 12 as they are fed from their respective warp beam to traverse back and forth relative to the needle bar by a travel distance of four needle locations 15, 15A to lay the yarns 12 without stitch formation about the needles 15 in a repeating 4-4, 0-0 inlay pattern. Simultaneously, the weft insertion device of the knitting machine is activated during the formation of each successive fabric course to insert the filling yarn 14 weftwise through the chain stitch needle loops of the ground yarn 10. As the relative knitting actions of the needle bar, the middle and bottom guide bars, and the weft insertion device are executed, the top guide bar serves to insert the spaced tubes T between the inlay yarns 12 and the filling yarns 14 along the length of the fabric in the spaced areas of the missing needles 15A.

As will thus be understood, the ground, inlay and filling yarns 10,12,14 are interknitted with one another by formation of chain stitch needle loops 10*n* of the ground yarns 10 longitudinally within each wale W of each course C of the resultant fabric except the wales W1 corresponding to the removed needle locations 15A, with the inlay yarns 12 and the filling yarn 14 extending transversely, i.e. coursewise, through each needle loop 12*n* of the ground yarns 12 in each wale W and across the wales W1 of each course C. More specifically, the inlay pattern followed by the inlay yarns 12 causes each of the yarns to traverse coursewise back and across four wales W, W1 in each course C, while each filling yarn 14 extends the full width of the fabric in each course C. The inlay and filling yarns 12,14 appear at opposite faces of the resultant fabric and therefore capture the tubes T therebetween within each spaced pair of wales W1.

As those persons skilled in the art will recognize, the respective stitch and inlay patterns followed by the yarns 10,12,14 cooperate to integrate one another into a fabric structure having a high degree of dimensional stability and integrity, i.e. a high resistance to stretchability, the chain stitch pattern of the ground yarns 10 resisting walewise stretchability while the coursewise orientations of the inlay and filling yarns resist coursewise stretchability. The tubes T are therefore securely held in a walewise essentially linear orientation in spaced parallel relation to one another.

Figure 2:
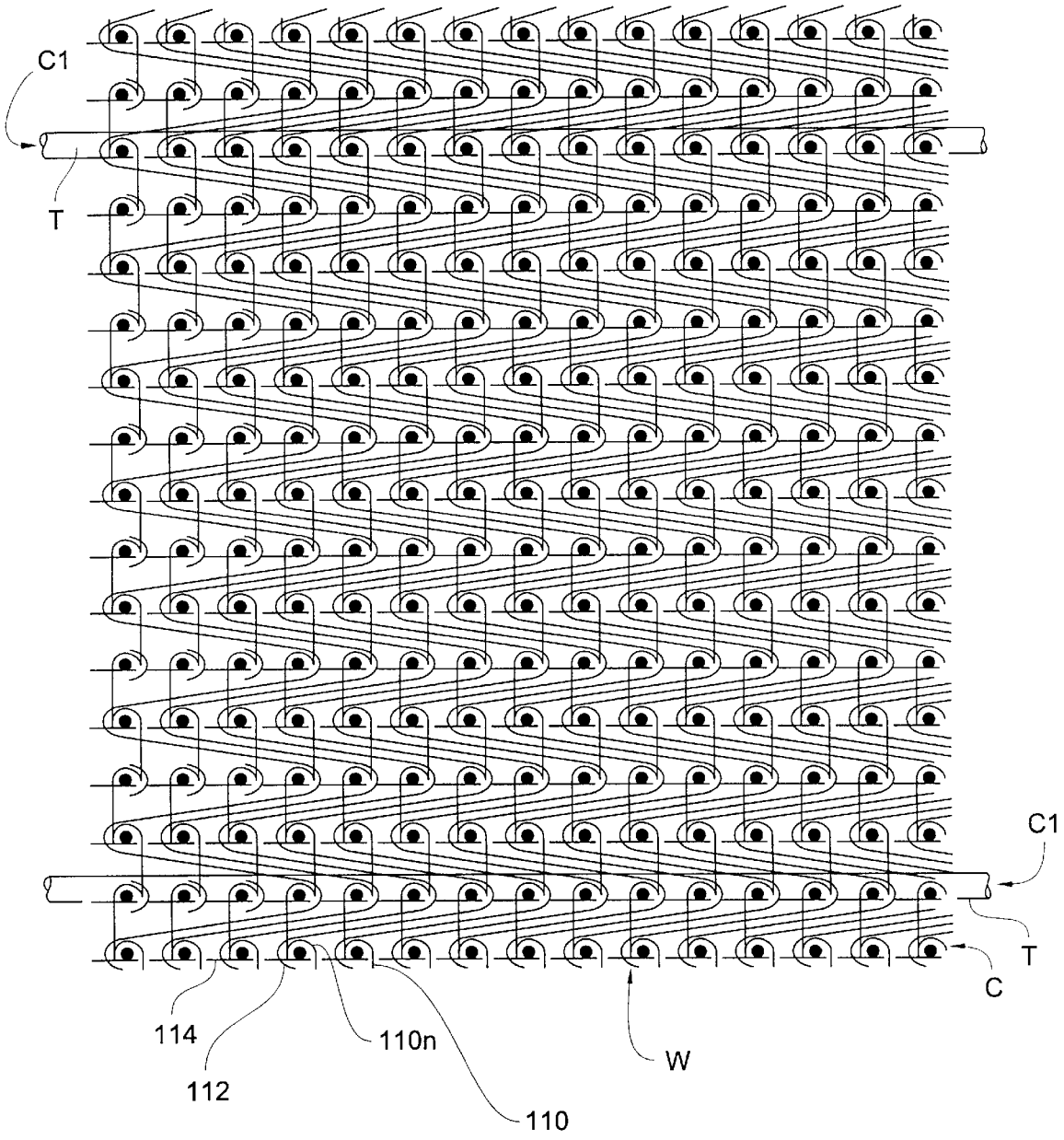
FIG. 2 is another schematic diagram, similar to FIG. 1, depicting the fabric structure and the individual stitch patterns of the constituent yarns thereof, in another variation of the preferred warp knitted embodiment of the textile fabric of the present invention.

An alternative embodiment of the present textile fabric is shown in FIG. 2. The fabric of FIG. 2 is similar to that of FIG. 1 in that the fabric structure comprises ground, inlay and filling yarns 110,112,114 interknitted with one another in the identical stitch, inlay and weft insertion patterns as the above-described fabric illustrated in FIG. 1. The fabric of FIG. 2 differs from that of FIG. 1 in that the tubes T are inserted coursewise utilizing the weft insertion device, whereby this fabric may be formed on a two-bar weft-insertion warp knitting machine. Thus, no needles have been omitted from the needle bar and the bottom and top guide bars are fully threaded with the ground and inlay yarns 100,112, i.e., every guide eye in the bottom guide bar carries a ground yarn 110 and every guide eye in the top guide bar carries an inlay yarn 112, whereby the ground and inlay yarns 110,112 are formed in every wale W of every course C. The filling yarn 14 in this fabric is inserted weftwise in every course C, except selected spaced courses C1, in which courses C1 the tubes T are inserted weftwise by the weft insertion device to extend coursewise through the needle loops/10*n* of the ground yarns/10 within such courses C1 for the full transverse width of the fabric. Otherwise, the selection of yarn type, yarn size, machine gauge, tube size and type, etc., may be varied in similar manner and according to essentially the same parameters and criteria as discussed above in connection with the fabric of FIG. 1. The stitch, inlay and weft insertion patterns followed by the ground, inlay and filling yarns 110,112,114 form a dimensionally stable fabric structure in which the tubes T are securely retained coursewise in spaced substantially parallel relation to one another.

The advantages and potential applications of the fabric of the present invention will be readily recognized and understood by those persons skilled in the art. The ability to fabricate a substrate containing spaced parallel fluid-carrying tubes utilizing a conventional warp knitting machine offers economies and cost savings over conventional substrate-forming techniques and processes, without affecting the functionality and range of potential applications to which the composite fabric may be put. While the dimensional stability of the fabric is effective to securely retain the tubes T in desired disposition within the fabric structure and with respect to one another, the flexibility of textile fabrics in general and the described fabric in particular, and the inherent ability of such fabric to be cut as desired to any selected shape and/or size, together with the appropriate selectability of tubes T of differing sizes, flexibilities and other physical characteristics, enables the fabric of the present invention to be adapted to many various configurations and potential applications. In any given application, little difficulty is anticipated in connecting the exposed ends of the respective tubes at opposite sides or opposite ends of the fabric (depending upon the embodiment of the fabric) with one another by the use of connector elbows or the like, and/or with appropriate intake and exhaust tubing or manifolds. The ability of textile fabrics to be laminated to or otherwise incorporated with other substrates or materials is well known, which further enhances the range of potential applications possible for the present fabric. By way of example but without limitation, it is contemplated that the present fabric could be laminated or otherwise bonded to a foam substrate for use in applications such as carrying heated or cooled fluid within automobile seats. In other applications, the opposite ends of the tubes could be sealed so as to contain air or other gas therewithin, to improve or enhance the flotation characteristics of the fabric, whereby the fabric would have increased potential application in flotation devices. Many other potential uses and applications for the present fabric are contemplated to be possible, and therefore the present fabric is not intended to be limited to the examples discussed above.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A knitted textile fabric comprising yarn formed into interlooped stitches defining a fabric structure having a longitudinal extent and a transverse extent wherein the stitches are aligned longitudinally in a plurality of essentially parallel wales and transversely in a plurality of essentially parallel courses perpendicular to the wales, and a plurality of elongate hollow tubular segments integrated with the yarn into the fabric structure in spaced essentially parallel relation to one another, each tubular segment defining a fluid passage therein and having a rigidity sufficient to maintain a substantially constant cross-sectional dimension thereof resisting deformation such that constriction of the fluid passage is avoided.

2. A knitted textile fabric according to claim 1, wherein each tubular segment is open-ended for the passage of fluid therethrough.

3. A knitted textile fabric according to claim 2, wherein the tubular segments extend coursewise of the fabric structure.

4. A knitted textile fabric according to claim 2, wherein the tubular segments extend walewise of the fabric structure.

5. A knitted textile fabric according to claim 2, wherein the fabric structure is a warp knitted structure.

6. A knitted textile fabric according to claim 5, wherein the warp knitted structure is a dimensionally stable knitted structure.

7. A knitted textile fabric according to claim 6, wherein the warp knitted structure is an at least two-bar knitted structure comprising two sets of interlooped warp yarns.

8. A knitted textile fabric according to claim 7, wherein one set of the warp yarns are formed in a walewise chain stitch pattern and the other set of the warp yarns are formed in a coursewise inlay pattern.

9. A knitted textile fabric according to claim 8, wherein said one set of the warp yarns are formed in a 0-1, 1-0 chain stitch pattern and said other set of the warp yarns are formed in a 4-4, 0-0 inlay pattern.

10. A knitted textile fabric according to claim 5, wherein the stitches are omitted from selected spaced wales and the tubular segments are disposed longitudinally within the selected spaced wales.

11. A knitted textile fabric according to claim 5, wherein the tubular segments are weft inserted to extend coursewise within the stitches of selected spaced courses.

* * * * *